US006257841B1

(12) United States Patent
Eppli

(10) Patent No.: US 6,257,841 B1
(45) Date of Patent: Jul. 10, 2001

(54) REGULATING DEVICE FOR POSITIVE-DISPLACEMENT PUMPS

(75) Inventor: Konrad Eppli, Schwäbisch Gmünd (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/530,225

(22) PCT Filed: Oct. 22, 1998

(86) PCT No.: PCT/EP98/06709

§ 371 Date: Apr. 27, 2000

§ 102(e) Date: Apr. 27, 2000

(87) PCT Pub. No.: WO99/22143

PCT Pub. Date: May 6, 1999

(30) Foreign Application Priority Data

Oct. 27, 1997 (DE) ..... 197 47 341

(51) Int. Cl.[7] ..... F04B 49/00

(52) U.S. Cl. ..... 417/310; 137/117

(58) Field of Search ..... 417/300, 310, 417/440, 288, 295, 307; 180/422; 137/117, 115

(56) References Cited

U.S. PATENT DOCUMENTS

| | | | | |
|---|---|---|---|---|
| 3,644,065 | * | 2/1972 | Lettenmayer et al. | 417/300 |
| 3,656,870 | * | 4/1972 | Kusakabe et al. | 417/300 |
| 3,663,126 | * | 5/1972 | Langosch | 417/300 |
| 3,751,190 | * | 8/1973 | Cecchi | 417/288 |
| 4,396,033 | * | 8/1983 | Narumi et al. | 137/117 |
| 4,536,133 | * | 8/1985 | Seidl | 417/307 |
| 4,553,908 | * | 11/1985 | Merz | 417/310 |
| 4,701,111 | * | 10/1987 | Seidl | 417/300 |
| 4,715,793 | * | 12/1987 | Johann et al. | 417/300 |
| 5,209,648 | * | 5/1993 | Ishizaki et al. | 417/310 |
| 5,236,315 | * | 8/1993 | Hamao et al. | 417/295 |
| 5,810,565 | * | 9/1998 | Eppli | 417/300 |
| 6,041,883 | * | 3/2000 | Yokota et al. | 180/422 |

FOREIGN PATENT DOCUMENTS

| | | |
|---|---|---|
| 33 2451 | 1/1921 | (DE) . |
| 29 30 107 | 2/1981 | (DE) . |
| 32 11948 | 7/1984 | (DE) . |
| 29 16575 | 7/1986 | (DE) . |

* cited by examiner

*Primary Examiner*—Teresa Walberg
*Assistant Examiner*—Leonid Fastovsky
(74) *Attorney, Agent, or Firm*—Larson & Taylor PLC

(57) ABSTRACT

In a regulating device for positive-displacement pumps, in particular vane cell and roller cell pumps, a pressure chamber of the pump can be connected with an outlet duct (14) via a bore (13), in which a regulating piston (17) is displaceable against the force of a spring (16). A flow control valve (11) is arranged for regulating a useful flow. In the area of the bore (13) containing the regulating piston (17), the pressure chamber is in continuous connection with a spring chamber (15) of the regulating piston (17) via a bypass duct (18). As a function of the delivery flow of the positive-displacement pump, the regulating piston (17) controls the open cross-sectional surface of a throttle duct (12), which connects the spring chamber (15) with the outlet duct (14). The regulating piston (17) has a control edge (19), by of which the open cross-sectional surface of the throttle duct (12) is reduced during a movement of the regulating piston (17) in the direction toward the spring chamber (15). The regulating piston (17) moreover has a further control edge (20) which, in the course of a further movement of the regulating piston, increases the open cross-sectional surface of the throttle duct (12).

7 Claims, 1 Drawing Sheet

REGULATING DEVICE FOR POSITIVE-DISPLACEMENT PUMPS

FIELD OF THE INVENTION

The invention relates to a regulating device for positive-displacement pumps, in particular vane cell and roller cell pumps having a pressure chamber, which is connected with a pressure duct connected to an outlet via a bore, in which a regulating piston can be displaced against the force of a spring. The regulating piston controls the outlet cross section of a throttle duct as a function of the number of revolutions of the pump, or respectively of the flow rate. The regulating piston has a control edge for this purpose, by means of which, and in connection with the opening of the throttle duct, the open cross-sectional surface of the throttle duct is reduced in the course of the movement of the regulating piston in the direction toward the spring chamber. In addition, a flow control valve with a control piston charged by the force of a spring is provided in a housing bore.

BACKGROUND OF THE INVENTION

Such a regulating device is known from WO-A1-96/09475. (also DE 44 38 398.9 or U.S. Pat. No. 5,810,565) The descending characteristic curve of the flow rate is attained with this regulating device. In order to make possible different shapes of the characteristic flow rate curve, it is necessary to use different springs and different piston diameters. If, however, a characteristic flow rate curve of an unsteady course is desired, for example of a stepped course, such a characteristic curve can only be realized with an increased outlay, for example by using two successively acting springs.

BRIEF SUMMARY OF THE INVENTION

The object of the invention is based on providing a regulating device for any arbitrary descending characteristic flow rate curves, among them also descending ones, which have an unsteady course, with the least possible structural outlay. It should be easily possible to represent different shapes of the characteristic curve.

This object is achieved by the regulating device of the present invention. The regulating piston has at least one control edge by means of which, together with the opening of the throttle duct, the cross-sectional surface of the throttle circuit is reduced during a movement of the regulating piston in the direction toward the spring chamber. Moreover, the regulating piston has at least one further control edge, by means of which, together with the opening of the throttle duct, the cross-sectional surface of the throttle circuit is increased during a movement of the regulating piston in the direction toward the spring chamber. It is possible by means of such an embodiment that the characteristic flow rate curve of the positive-displacement pump shows a descending course starting at the point at which the first control edge begins to cover the opening of the throttle duct, and in this way to reduce the open cross-sectional surface of the throttle duct. The flow delivered to the consumer is reduced by this. Starting at a second point, where the second control edge enters the area of the opening of the throttle duct, the open cross-sectional surface of the throttle duct in this area is increasingly enlarged. This results in an unsteady point in the course of the characteristics flow rate curve, for example to the effect that from this point on the characteristics curve descends less steeply or not at all anymore. The amount regulated away by the first control edge is definitely regulated back by the second control edge.

Advantageous and useful embodiments of the invention are recited hereinbelow. The control edges can be embodied particularly easily if the first control edge is constituted by a cut between the front face of the regulating piston facing the spring chamber and the cylindrical circumferential face of the regulating piston. The further control edge then is designed as a limit edge of an annular groove arranged on the cylindrical circumferential surface of the regulating piston.

In a second exemplary embodiment, both control edges are constituted by respective limit edges of two annular grooves arranged on the cylindrical circumferential surface of the regulating piston. It is possible by means of this to set the characteristic flow rate curves with greater variety. For example, a characteristic flow rate curve results as a function of viscosity, which has particularly good cold-starting properties.

BRIEF DESCRIPTION OF THE DRAWINGS

The invention will be explained in greater detail in what follows by means of two exemplary embodiments represented in the drawings. Shown are in FIG. 1, a longitudinal section through the positive-displacement pump with the regulating device, wherein the regulating piston is in its basic position, FIG. 2, a partial section along the line II—II in FIG. 1, FIG. 3, the detail III in FIG. 1 on an enlarged scale, FIG. 4, the detail III in FIG. 3, but with the regulating piston displaced, and FIG. 5, the detail III as in FIG. 3, but in accordance with a second exemplary embodiment.

DETAILED DESCRIPTION OF THE INVENTION

Figure 1:
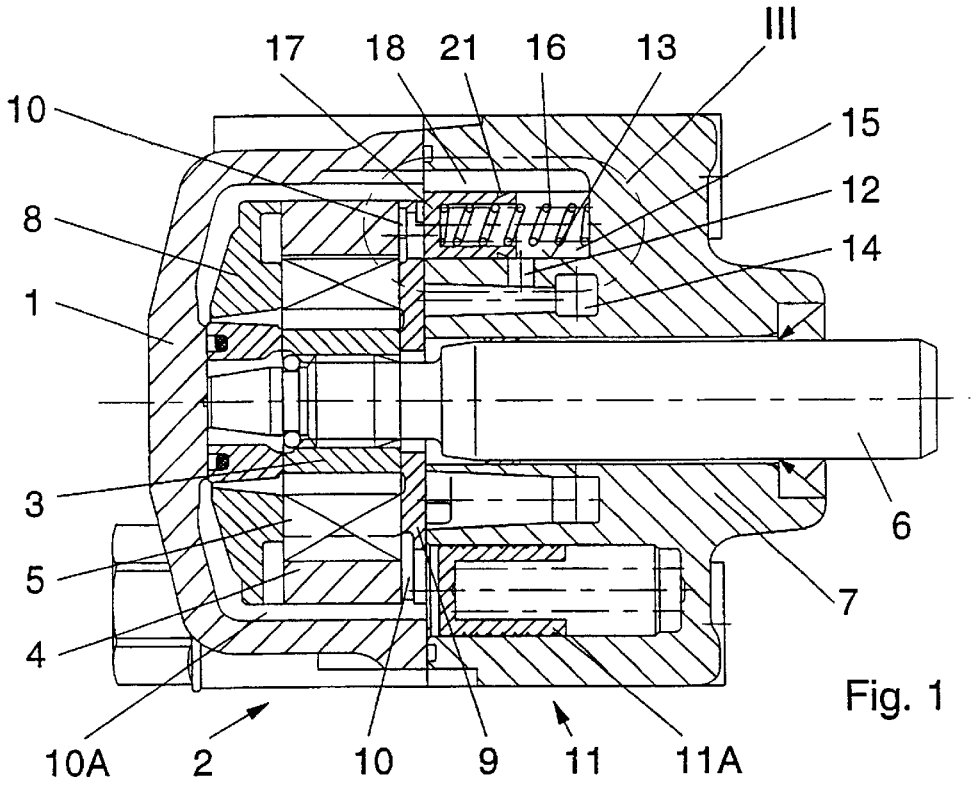

The invention will be described by means of the example of a vane cell pump. However, the invention can be employed with the same effect with other positive-displacement pumps, for example with roller pumps. The vane cell pump is used for delivering hydraulic oil from a reservoir, not represented, to a consumer, not represented, for example a servo-assisted steering system.

A pump package 2 has been installed in a housing 1 and consists of a rotor 3, a cam ring 4 and several operating slides 5. The rotor 3 is seated on a driveshaft 6 in a bearing housing 7.

Work chambers, not represented, in the form of displacement cells are formed between the operating slides 5 and the cam ring 4 and are delimited on their two axial sides by two control plates 8 and 9. In a known manner, pressure openings 10 and suction openings, not represented, are provided in the control plates 8 and 9. The pressure openings 10 are connected with a pressure chamber 10A.

A bypass flow control valve 11 with a piston centrol 11 A charged by a spring has been arranged in a known manner in the bearing housing 7 for regulating the hydraulic oil delivered to a pressure connection. The design of the flow control valve 11 and of a pressure relief valve, not visible, which is additionally provided, is generally known, for example from U.S. Pat. No. 5,098,259, and will therefore not be described in greater detail. The suction and pressure ducts, which connect the work chambers with a suction connection, the flow control valve 11, and the pressure relief valve are also arranged in the bearing housing 7. These ducts are also generally known and will therefore not be described in greater detail. An orifice of the bypass flow control valve 1 1 is arranged in the form of a throttle duct 12 in the bearing housing 7.

Figure 2:
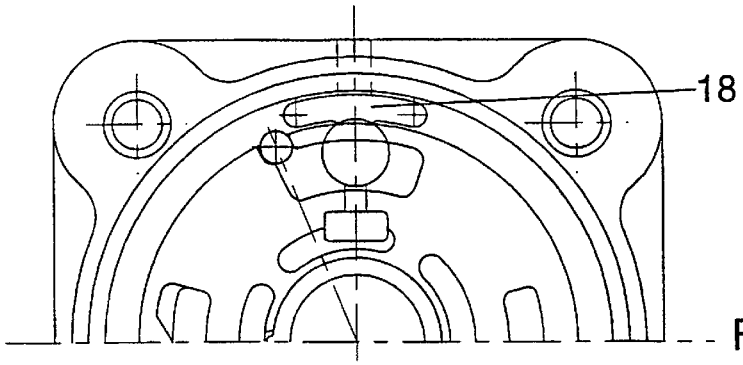
Figure 3:
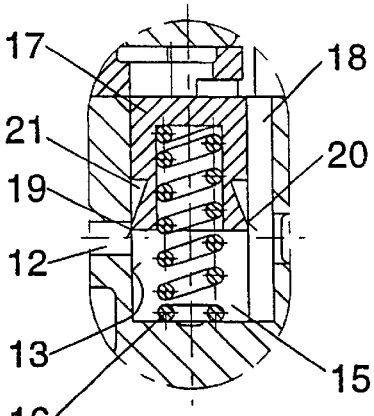
Figure 4:
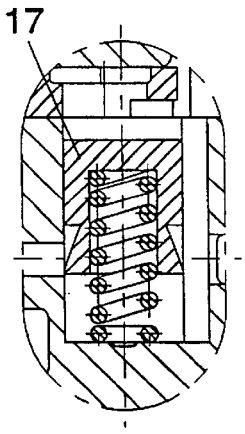

The throttle duct 12 extends from a bore 13, which is arranged in the bearing housing essentially parallel in respect to the axis of the driveshaft 6, to an outlet duct 14. The opening of the throttle duct 12 terminates in the bore 13 in a spring chamber 15, containing a spring 16. On the one end, the spring 16 is supported on the end of the bore 13 in the bearing housing 7, and on the other end on a regulating piston 17, which is displaceably guided in the bore 13. The pressure openings 10 are continuously connected via a bypass duct 18 with the spring chamber 15, and therefore with the opening of the throttle duct 12. As can be seen from the cross section in FIG. 2, the bypass duct 18 is designed to be essentially T-shaped and is usefully cast into the bearing housing 7. The bypass duct 18 is open toward the bore 13. The regulating 17 can be displaced against the force of the spring 16. In every position of the regulating piston 17, a connection between the pressure openings 10 and the spring chamber 15 is maintained via the bypass duct 18.

The regulating piston 17 has a control edge 19 on its end facing the spring chamber 15, which is constituted by the cut between the front face of the regulating piston 17 facing the spring chamber 15, and its cylindrical circumferential surface. The control edge 19 works together with the opening of the throttle duct 12 in such a way that the open cross-sectional surface of the throttle duct 12 is reduced when the regulating piston 17 is displaced in the direction toward the spring chamber 15. The control edge 19 can be designed as a sharp edge, as a step, or as a bevel. The throttle process can be affected by such a design of the control edge 19.

The regulating piston has a further control edge 20 in the vicinity of its end facing the spring chamber 15, which is constituted by a limit edge of an annular groove 21 arranged in the cylindrical circumferential surface of the regulating piston 17.

Figure 5:
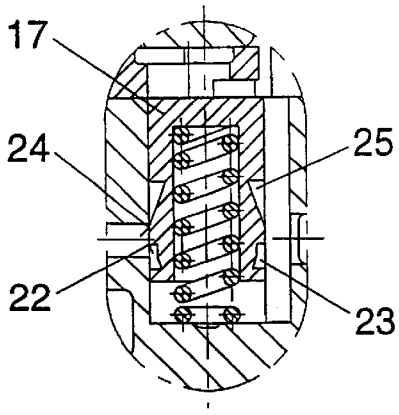

In a second exemplary embodiment represented in FIG. 5, a first control edge 22 is formed by a limit edge of a first annular groove 23. A second control edge 24 is formed by a limit edge of a second annular groove 25. The two annular grooves 23 and 25 are formed on the cylindrical circumferential surface of the regulating piston 17 in the vicinity of the front face of the regulating piston 17 facing the spring chamber 15.

The function of the regulating piston 17 will be described in what follows: in the initial position, as long as the pump is stopped, the spring 16 pushes the regulating piston 17 against the control plate 9. The delivery pressure of the pump acts in the pressure openings 10, and therefore as back pressure on the front face of the regulating piston 17 facing away from the spring chamber 15. As soon as the force of the back pressure acting on the front face exceeds the force of the spring 16, the regulating piston 17 is displaced in the direction toward the spring chamber 15. In the process, the open cross-sectional surface of the throttle duct 12 is initially reduced by the control edge 19. In the course of the continued displacement of the regulating piston 17, the second control edge 20 comes into the area of the opening of the throttle duct 12, so that the open cross-sectional surface of the throttle duct 12 is enlarged in this area with the increasing displacement of the regulating piston 17. Following the initial reduction of the open cross-sectional surface and therefore a descending characteristic flow rate curve, in the course of the continued displacement of the regulating piston 17 it is possible to maintain constant, or respectively to continuously increase, the open cross-sectional surface. By means of this it is possible to delicately vary the rise of the characteristic flow rate curve in the regulation range of the positive-displacement pump. The characteristic flow rate curve can be delicately varied by a change in the shape of the regulating piston 17 alone. Such a different shape of the regulating piston 17 has been described above by means of FIG. 5.

What is claimed is:

1. A positive displacement pump for a fluid comprising:

a pressure chamber for the pumped fluid;

an outlet duct for the pumped fluid of said pressure chamber;

a bypass flow control valve which controls a useful flow of the pumped fluid; and a regulating device which regulates a delivery flow of the pumped fluid to said outlet duct including a) a spring chamber having a first portion and a second portion, b) a regulating piston disposed in said first portion of said spring chamber with a first end subject to a pressure of said pressure chamber and a second end facing said second portion of said spring chamber, c) a spring disposed in said spring chamber which acts on the second end of said regulating piston and against the pressure exerted on the first end of said regulating piston, d) a bypass duct which connects said pressure chamber with said second portion of said spring chamber, e) a throttle duct which connects said second portion of said spring chamber with said outlet duct, said throttle duct having an open cross-sectional surface which opens into said second portion of said spring chamber and which is adjacent to said second end of said regulating piston, and f) a first control edge and a second control edge on said second end of said regulating piston such that as said regulating piston moves by an increasing pressure exerted on the first end of said regulating piston against said spring, (i) said first control edge of said second end is initially moved over said throttle duct causing a reduction of said open cross-sectional surface thereof which in turn limits fluid flow through said throttle duct and hence through said outlet duct, and (ii) said second control edge of said second end is thereafter moved over said throttle duct causing an increase of said open cross-sectional surface thereof which in turn increases fluid flow through said throttle duct and hence through said outlet duct relative to when only said first control edge was moved over said throttle duct.

2. A positive displacement pump as claimed in claim 1, wherein said bypass flow control valve includes a flow control piston and a spring which acts against said flow control piston.

3. A positive displacement pump as claimed in claim 1:

wherein said regulating piston has a cylindrical circumferential surface;

wherein said first control edge is formed at an intersection of said second end of said regulating piston and said circumferential surface; and wherein said second control edge is formed by a limit edge of an annular groove in said circumferential surface.

4. A positive displacement pump as claimed in claim 1:

wherein said regulating piston has a cylindrical circumferential surface;

wherein said first control edge is formed by a limit edge of a first annular groove in said circumferential surface; and wherein said second control edge is formed by a limit edge of a second annular groove in said circumferential surface.

5. A regulating device for regulating a delivery flow of fluid pumped by a positive displacement pump, where the displacement pump includes (a) a pressure chamber for the pumped fluid, (b) an outlet duct for the pumped fluid of said pressure chamber, and (c) a bypass flow control valve which controls a useful flow of the pumped fluid, said regulating device comprising:

a spring chamber having a first portion and a second portion;

a regulating piston disposed in said first portion of said spring chamber with a first end subject to a pressure of the pressure chamber and a second end facing said second portion of said spring chamber;

a spring disposed in said spring chamber which acts on the second end of said regulating piston and against the pressure exerted on the first end of said regulating piston;

a bypass duct which connects the pressure chamber with said second portion of said spring chamber;

a throttle duct which connects said second portion of said spring chamber with the outlet duct, said throttle duct having an open cross-sectional surface which opens into said second portion of said spring chamber and which is adjacent to said second end of said regulating piston; and a first control edge and a second control edge on said second end of said regulating piston such that as said regulating piston moves by an increasing pressure exerted on the first end of said regulating piston against said spring, (i) said first control edge of said second end is initially moved over said throttle duct causing a reduction of said open cross-sectional surface thereof which in turn limits fluid flow through said throttle duct and hence through the outlet duct, and (ii) said second control edge of said second end is thereafter moved over said throttle duct causing an increase of said open cross-sectional surface thereof which in turn increases fluid flow through said throttle duct and hence through the outlet duct relative to when only said first control edge was moved over said throttle duct.

6. A regulating device as claimed in claim 5:

wherein said regulating piston has a cylindrical circumferential surface;

wherein said first control edge is formed at an intersection of said second end of said regulating piston and said circumferential surface; and wherein said second control edge is formed by a limit edge of an annular groove in said circumferential surface.

7. A regulating device as claimed in claim 5:

wherein said regulating piston has a cylindrical circumferential surface;

wherein said first control edge is formed by a limit edge of a first annular groove in said circumferential surface; and wherein said second control edge is formed by a limit edge of a second annular groove in said circumferential surface.

* * * * *